US005768918A

United States Patent [19]

McKibben

[11] Patent Number: 5,768,918

[45] Date of Patent: Jun. 23, 1998

[54] RINSE WATER ADDITIVE DISPENSER

[75] Inventor: Gary E. McKibben, Middletown, Ohio

[73] Assignee: The Procter & Gamble Company, Cincinnati, Ohio

[21] Appl. No.: 834,580

[22] Filed: Apr. 7, 1997

[51] Int. Cl.[6] ..... D06F 39/02

[52] U.S. Cl. ..... 68/17 R; 222/500

[58] Field of Search ..... 68/17 R, 213, 68/235 R; 222/212, 500

[56] References Cited

U.S. PATENT DOCUMENTS

| | | | |
|---|---|---|---|
| T993,001 | 4/1980 | McCarthy | 68/17 |
| 2,956,709 | 10/1960 | Nison et al. | 222/52 |
| 2,970,463 | 2/1961 | Johnston | 68/17 |
| 3,044,665 | 7/1962 | Ludwig et al. | 222/129 |
| 3,108,722 | 10/1963 | Torongo, Jr. et al. | 222/463 |
| 3,180,538 | 4/1965 | Brown et al. | 222/500 |
| 3,201,111 | 8/1965 | Afton | 267/1 |
| 3,215,311 | 11/1965 | Nison et al. | 222/52 |
| 3,316,741 | 5/1967 | Harlow et al. | 68/207 |
| 3,620,054 | 11/1971 | Drews et al. | 68/17 |
| 3,633,538 | 1/1972 | Hoeflin | 118/76 |
| 3,699,785 | 10/1972 | Waugh | 68/17 |
| 3,888,391 | 6/1975 | Merz | 222/52 |
| 4,026,131 | 5/1977 | Dugger et al. | 68/17 |
| 4,211,156 | 7/1980 | Zimmermann | 99/287 |
| 4,379,515 | 4/1983 | Towsend | 222/52 |
| 4,549,693 | 10/1985 | Barlics | 239/58 |
| 4,656,844 | 4/1987 | Mulder et al. | 68/17 |
| 4,835,804 | 6/1989 | Arnau-Munoz et al. | 8/158 |
| 5,033,643 | 7/1991 | Schumacher | 222/52 |
| 5,040,311 | 8/1991 | Roy | 34/60 |
| 5,267,671 | 12/1993 | Baginski et al. | 222/154 |

FOREIGN PATENT DOCUMENTS

| | | | |
|---|---|---|---|
| WO 89/07678 | 8/1989 | WIPO | D06F 39/02 |
| WO 89/10445 | 11/1989 | WIPO | 68/17 R |

*Primary Examiner*—Philip R. Coe

*Attorney, Agent, or Firm*—Ronald W. Kock; Jack L. Oney, Jr.; William Scott Andes

[57] ABSTRACT

An improved rinse water additive dispenser for an automatic washer has a substantially rigid body having a resilient portion and an internal volume. The dispenser further includes an opening therein and a valve for sealing the opening closed so that the rinse water additive is maintained within the dispenser until the valve is acted upon by centrifugal force applied to the dispenser during a spin cycle of the automatic washer to unseat the valve. The resilient portion provides for volumetric expansion and contraction of the dispenser when the dispenser is placed in variable temperature water. The volumetric expansion and contraction substantially relieves an air pressure differential between ambient and the internal volume so that the centrifugal force unseats the valve without interference from the pressure differential. The opening may be in the resilient portion or in the substantially rigid body.

12 Claims, 3 Drawing Sheets

RINSE WATER ADDITIVE DISPENSER

FIELD OF THE INVENTION

The present invention relates to an improved dispenser for providing a rinse water additive to an automatic washing machine, and more particularly to such a dispenser wherein the reliability of operation and reduction in messiness of handling is improved.

BACKGROUND OF THE INVENTION

Rinse water additive dispensers are well known in the art. Examples include U.S. Pat. Nos. 5,267,671 to Baginski et al.; 3,108,722 to Torongo, Jr. et al.; 3,888,391 to Merz, and 4,835,804 to Arnau-Munoz et al. Centrifugal force applied to a weight inside the dispenser during a spin cycle of an automatic clothes washer causes a dispenser valve to become unseated so that additive from the dispenser may spill out of the dispenser and mix with rinse water that is added to the washer after the spin cycle. Additives include fabric softeners. The dispenser is normally inserted into the washer before the wash cycle begins. It must remain closed during the agitation of the wash cycle, yet reliably open during the spin cycle at the conclusion of the wash cycle in order to deliver the rinse water additive at a point in time which will be effective.

The dispenser is typically a cylinder or a ball shaped container which has a large circular opening at one end. The dispenser is normally only partially filled with an additive, such that the dispenser primarily contains air and space for a valve to be actuated. A dispenser valve is typically a resilient rubber device, such as a pair of interconnected rubber disks acting as a grommet at the edge of the circular opening. A rigid arm extending from the pair of rubber disks, parallel to the axis of the opening, has a counterweight connected to the arm. In a closed valve position the rubber disks seal the opening from both sides such that washwater cannot enter and additive cannot leave. Gravity acting upon the counterweight is insufficient to cause the disks to be deformed and pop out of the opening to open the valve. However, centrifugal force generated by the spin cycle of the washer, is sufficient to pull the arm at an angle to the axis of the opening, thereby distorting the rubber disks and causing them to pop out of engagement with the edges of the opening. The valve remains open thereafter so that as the washer fills with rinse water, the additive from the dispenser may spill out, and/or the rinse water may fill the dispenser and mix with the additive.

Upon completion of the total wash and rinse cycle, the washer attendant removes the clothes and the dispenser. With the valve open, the attendant may refill the dispenser with additive for another wash load. To reclose the valve, which is normally attached into the dispenser by a chain or flexible cord, the attendant pulls the valve device such that the rubber disks snap back into engagement with the edge of the opening.

Various problems with the conventional dispenser reduce the reliability associated with dispensing additive at the correct time. For example, when a room temperature dispenser is placed in the wash, the valve is sealed by the resilience of the rubber disks. However, when the hot washwater is added, the dispenser heats up and air pressure builds inside the dispenser, causing added resistance to open the valve during the spin cycle. Sufficient air pressure may prevent centrifugal force opening the valve, in which case the dispenser will fail to provide its intended function.

Alternatively, a cold water wash cycle may generate a vacuum inside the dispenser and cause it to open prematurely during the wash cycle agitation. Although the attendant will not realize that the additive has been dispensed at the wrong time, the dispenser will still have failed in its function.

Vents have been used to prevent pressure or vacuum from developing within a dispenser, but eventually the vents become plugged with the additive fluid, which may dry to leave a waxy residue. What is needed is another way to relieve pressure or vacuum developed within the dispenser.

Another problem with conventional dispensers is the messiness involved with reclosing the valve. Chains or cords connected to the valve are ultimately contaminated with additive when the dispenser is filled because they extend into the inside of the dispenser when the valve is open. It is by the chain or cord that the attendant must pull the valve back into its closed position. What is needed is another way to close the valve which does not involve touching components exposed to the additive.

Still another problem with conventional dispensers is the pull chain or cord can get caught up in the clothes being washed such that during the spin cycle, the valve cannot be opened by centrifugal force. What is needed is a dispenser that has no exposed chain or cord outside the dispenser.

SUMMARY OF THE INVENTION

In one aspect of the present invention, an improved rinse water additive dispenser for an automatic washer having a spinning drum comprises a substantially rigid body having a resilient portion and an internal volume. The dispenser further includes an opening therein and a valve for sealing the opening closed so that the rinse water additive is maintained within the dispenser until the valve is acted upon by centrifugal force applied to the dispenser during a spin cycle of the automatic washer to unseat the valve. The resilient portion provides for volumetric expansion and contraction of the dispenser when the dispenser is placed in variable temperature water. The volumetric expansion and contraction substantially relieves an air pressure differential between ambient and the internal volume so that the centrifugal force unseats the valve without interference from the pressure differential. The dispenser opening may be in the resilient portion or in the substantially rigid body. If in the resilient portion, there may be a separate member attached to the resilient portion in order to provide a flat and smooth valve seat around the opening for properly seating the valve.

In another aspect of the present invention, an improved rinse water additive dispenser for an automatic washer having a spinning drum comprises a substantially rigid portion having an internal volume and a resilient bellows portion connected to and in fluid communication with the rigid portion. Either the rigid portion or the resilient bellows portion has an opening therein surrounded by a valve seat. The dispenser further comprises a valve seated on the valve seat to seal the opening and provide a closed dispenser. The valve has a rigid counterweight extending downward therefrom. The counterweight has a center of gravity along an axis substantially perpendicular to and centered on the opening. The counterweight is sized to be pulled away from the axis in the presence of centrifugal force acting thereon during a washer spin cycle so as to unseat the valve and thereby open the dispenser so that an additive in the dispenser may thereafter mix with rinse water when the automatic washer fills with rinse water. The resilient bellows portion provides for voluntary expansion and contraction of the closed dispenser when the dispenser is placed in variable temperature water. The volumetric expansion and contraction substantially relieves an air pressure differential between ambient and the internal volume so that the centrifugal force unseats the valve with minimal interference from the pressure differential. The resilient bellows preferably has a collapse resistance sufficient to minimize bellows distortion when centrifugal force pulls the counterweight away from the axis, so that the force may unseat the valve.

The rigid counterweight preferably has a base which mates with an internal bottom surface of the dispenser when the valve is unseated, in order to substantially center the valve along the axis of the opening. The resilient bellows portion may then be manually deformed to lower the valve seat into engagement with the valve after refilling the dispenser.

The internal bottom surface may have an upright projection for engagement with a recessed surface of the counterweight, or the internal bottom surface may have a recessed surface for engagement with a matingly shaped counterweight to align the counterweight along the axis after it falls from the valve seat position.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
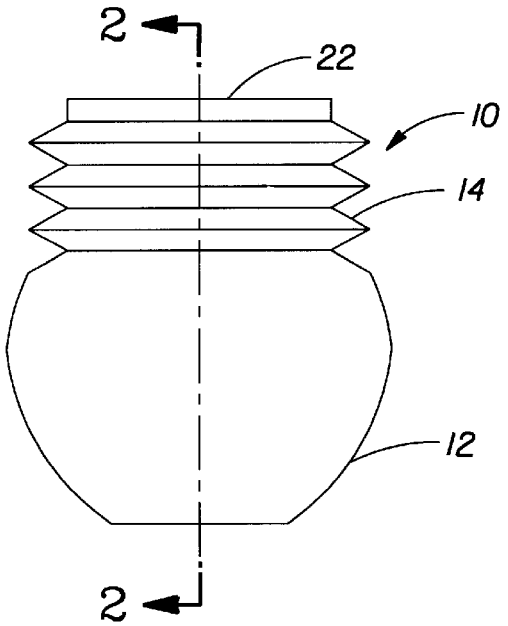
FIG. 1 is a front elevation view of a preferred embodiment of the improved dispenser of the present invention, disclosing a rigid lower portion and a resilient bellows upper portion.
Figure 2:
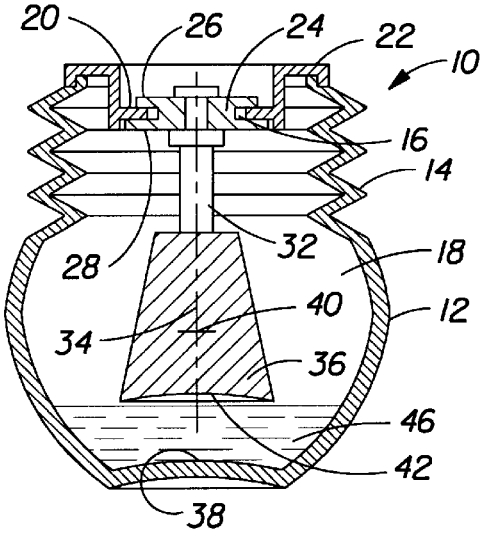
FIG. 2 is a sectioned side elevation view thereof, taken along section line 2—2 of FIG. 1, showing the dispenser having fluid ready to dispense and a valve seated in a seat located in the resilient bellows upper portion.

Referring now to the drawings, and more particularly to FIGS. 1 and 2, there is shown a first preferred embodiment of the present invention, which provides an improved dispenser generally indicated as 10. Dispenser 10 has a construction which is generally in accordance with the teachings of commonly assigned U.S. Pat. No. 5,267,671, issued to Baginski et al. on 12/7/93, which is hereby incorporated herein by reference. Improvements to the dispenser of Baginski et al are: a) the addition of a resilient bellows to the body of the dispenser, which allows for the internal volume of the dispenser to be changed; and b) the addition of a centering feature to the base of the counterweight, which enables the unseated valve to be positioned upright and centered on the dispenser opening and valve seat. The benefits of these two improvements is explained hereinafter.

Dispenser 10 has a substantially rigid body 12 and a resilient bellows portion 14, which are preferably injection-blow molded as one piece from a clarified polyolefin or PET. It is beneficial for the body to be clear so that the level of fluid additive may be observed from outside the dispenser when filling it to a fill line marked on the dispenser. Body 12 typically has a thicker wall than bellows portion 14. Alternatively, a separate pre-formed bellows is connected to rigid body 12 in a fluid-tight manner, such as by adhesive or fusion bonding, or by a gasketed mechanical fastening. The material and construction of body 12 and resilient portion 14 must be able to withstand the heat of hot laundry water and detergent.

Dispenser 10 also has an opening 16 for fluid communication with an internal volume 18. Opening 16 is surrounded by an annular valve seat 20. Because of the need for valve seat 20 to be flat and smooth, opening 16 is preferably made in an injection molded, substantially rigid, member 22, which is connected to bellows portion 14 in a fluid-tight manner, such as by adhesive or fusion bonding, or by a gasketed mechanical fastening.

Seated in opening 16 on valve seat 20 is a valve 24. Valve 24 has two parallel resilient disks 26 and 28 connected by a resilient cylinder. Valve 24 is mounted on a substantially rigid plastic stem 32. Valve 24 is preferably made of Shore A 58 durometer polyisoprene elastomer by an injection molding process. Plastic stem 32 is preferably made of polypropylene. Stem 32 extends downward along an axis 34 through the center of opening 16 from valve 24 to a counterweight 36, also made of polypropylene. Counterweight 36 extends into internal volume 18, but short of an internal bottom surface 38 of body 12.

Figure 7:
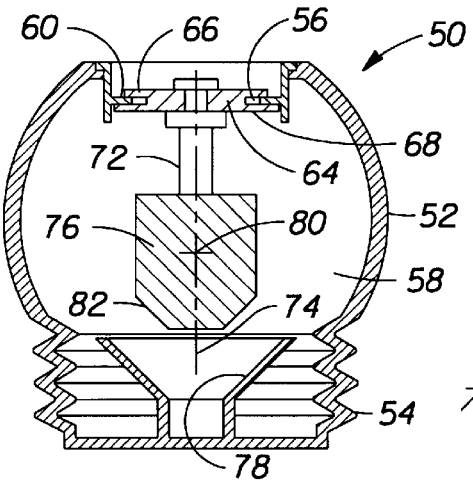
FIG. 7 is a sectioned side elevation view thereof, taken along section line 7—7 of FIG. 6, showing the dispenser having a valve seated in a seat located in the substantially rigid portion.
Figure 8:
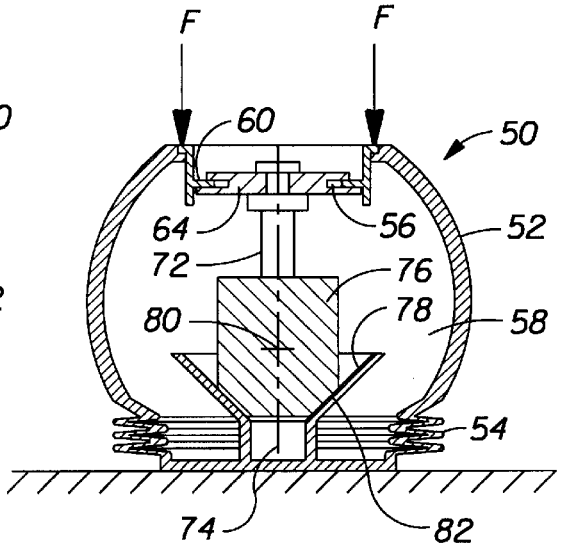
FIG. 8 is a sectioned side elevation view thereof, similar to FIG. 7, disclosing the upper body portion being pushed downward such that the valve seat engages the valve, as would normally happen after fluid is added to the lower portion.

Counterweight 36 preferably has a center of gravity 40, which is located substantially along; axis 34 when valve 24 is properly seated. Counterweight 36 also has a base 42, which is preferably recessed to mate with bottom surface 38. Bottom surface 38 preferably has an upright projection, such as a domed pushup, so that when valve 24 is unseated, base 42 is easily centered on bottom surface 38. Alternatively, the internal bottom surface may be recessed or funnel-shaped and the mating base of the counterweight may be convex or a truncated cone, as shown in FIGS. 7 and 8, to mate with a bottom surface to provide the centering function.

Figure 3:
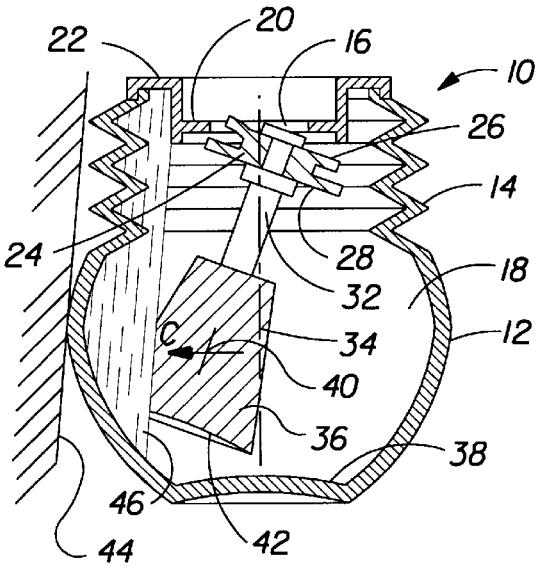
FIG. 3 is a sectioned side elevation view thereof, similar to FIG. 2, disclosing the valve being opened by centrifugal force acting against a counterweight suspended from the valve during a spin cycle of an automatic washer.
Figure 4:
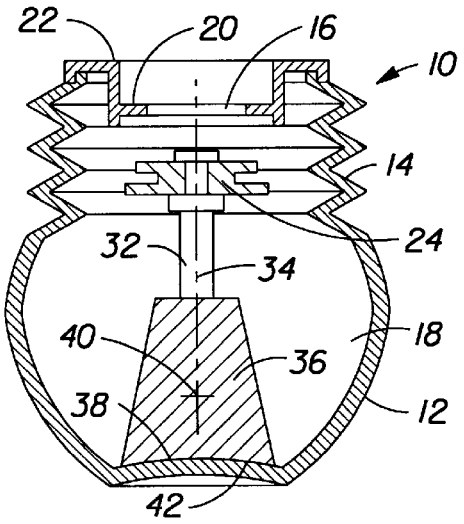
FIG. 4 is a sectioned side elevation view thereof, similar to FIG. 2, disclosing the emptied dispenser with valve centered and resting on the bottom surface of the lower body portion.

FIGS. 3 and 4 show how valve 24 is typically opened. Valve 24 is similar to a grommet, acting to seal against both sides of member 22 to close dispenser 10 by plugging opening 16. Counterweight 36 is sized to provide a torque on valve 24 when a centrifugal force C acts through center of gravity 40 during an automatic washer spin cycle, assuming dispenser 10 rests against its side on washer drum 44. Force C pulls counterweight 36 out of alignment with axis 34, causing outermost disk 26 to progressively slip and then totally pop inside opening 16, thereby unseating valve 24. Once unseated, valve 24 falls into internal volume 18 and rinse water is free to enter and mix with an additive fluid 46 in dispenser 10, and/or additive fluid 46 is free to spill out of dispenser 10 into the rinse water.

For a fabric softener, such as DOWNY®, a Trademark of The Procter & Gamble Company of Cincinnati, OH, it is desired to maintain the dispenser closed during a wash cycle, but to open and mix this fluid with rinse water during the rinse cycle. When fabric softener is dispensed in this manner, the dispenser may be conveniently placed in the laundry load at the very beginning of a wash cycle and removed only after the complete wash & rinse cycles are finished. Such a dispenser avoids the need to manually interrupt the wash and rinse cycles to add a fabric softener to the rinse water.

Resilient bellows portion 14 solves a problem with rinse water dispensers, wherein hot or cold wash water tends to heat or cool internal volume 18 of dispenser 10 and generate either a pressure or a vacuum. An internal pressure or vacuum act to influence the timing of opening of the dispenser. A vacuum caused by dispenser contact with cold water will provide a preload force on the valve which enables it to open prematurely, such as when the dispenser is impacted during the wash cycle. A pressure caused by dispenser contact with hot water will provide an opposite preload force, which may prevent the valve opening at all during the spin cycle when maximum centrifugal force is developed. However, the resilient bellows expands or contracts with the pressure or vacuum developed in the internal volume of the dispenser and thereby reduces the magnitude of the pressure or vacuum to an acceptable level such that there is minimal interference with the normal opening force applied to the valve.

Figure 9:
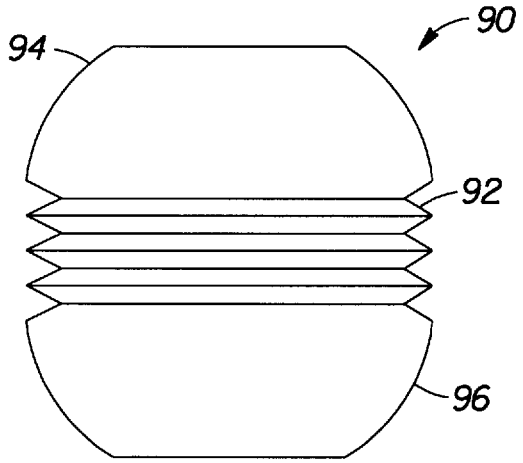
FIG. 9 is a front elevation view of yet another alternative preferred embodiment of the improved dispenser of the present invention, disclosing a substantially rigid body and a resilient bellows portion located between upper and lower body portions of the dispenser.

Valve seat 22 is shown connected to resilient bellows 14 in FIGS. 2–5 or connected to a substantially rigid body in FIGS. 7 and 8. Either alternative is feasible. When valve seat 22 is part of the resilient end of the dispenser, the resilience of the bellows portion must be limited such that centrifugal force C does not distort or deform the bellows portion an amount that prevents the valve from unseating. In order to minimize the bellows portion distortion or to reduce the stiffness needed in the bellows, the valve seat and dispenser opening may more preferably be located in the substantially rigid body opposite the resilient bellows portion. FIG. 9 shows an arrangement wherein the bellows portion is centrally located between two ends of the dispenser, such that the dispenser opening and the valve seat may be located at either end of the dispenser.

Figure 5:
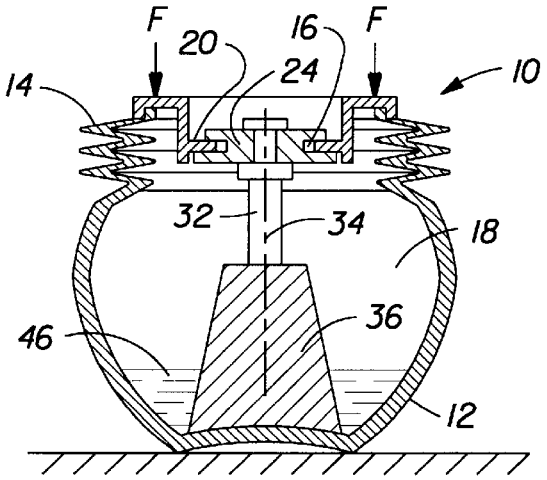
FIG. 5 is a sectioned side elevation view thereof, similar to FIG. 2, disclosing the upper portion being pushed downward such that the valve seat engages the valve after fluid is added to the lower body portion.

Another important aspect of the resilient bellows solves a second problem. Conventional dispensers have a chain or cord with a pull ring attached to the valve. This enables the unseated valve resting inside the dispenser to be pulled into engagement with the valve seat after refilling the dispenser. However, because the chain or cord extend through the opening for access by the attendant, the chain or cord become contaminated with additive fluid and are therefore messy to use when pulling the valve into a seated position. Improving the dispenser by adding both a resilient bellows and a counterweight centering feature permits the chain or cord to be eliminated. Instead of pulling the valve into valve seat engagement, the attendant merely shakes the dispenser to guarantee alignment of the valve and counterweight along axis 34 and then presses the opening end of the dispenser downward with force F until the valve reseats with the valve seat. This is shown in FIGS. 5 and 8.

The design of the centering feature must take into account the angle to which the counterweight must be pulled away from axis 34 in order to cause the valve to unseat. The angle is a function of the stiffness and thickness of the rubber disks and diameter of the opening relative to the diameters of the disks. In order for the allowable swing angle to be large, the diameter of base 42 must be limited. In order for base 42 to be centered by internal bottom surface 38, the diameter of the bottom surface must substantially correspond with that of base 42. Although self-centering is the objective, gentle shaking of the upright dispenser may be beneficial in aligning the counterweight base with the bottom surface. As a last resort for centering the valve and counterweight, the attendant may extend a finger into the dispenser to align the counterweight and valve prior to pouring fluid into the dispenser.

Figure 6:
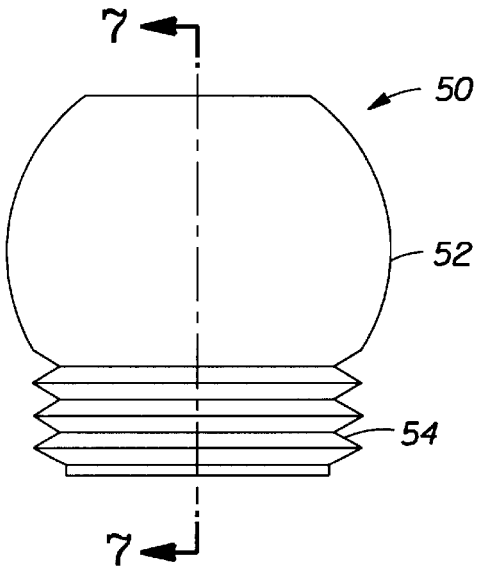
FIG. 6 is a front elevation view of an alternative preferred embodiment of the improved dispenser of the present invention, disclosing a substantially rigid upper body portion and a resilient bellows lower portion.

When resilient bellows portion 14 is compressed by force F, it has a tendency to spring back to the position shown in FIGS. 2, 6, and 9. In order to do so, air must vent into dispenser 10. However, if air vents into and out of dispenser 10, one might wonder how a pressure or vacuum, discussed hereinbefore, can be developed in dispenser 10. The answer is that when essentially dry, although the fluid additive may contaminate some surfaces of valve seat 22 and valve 24, valve 24 passes air into and out of dispenser 10 quite readily, allowing for bellows expansion to its normal position. However, when wet from a wash cycle, valve 24 tends to seal against valve seal: 22 in an air-tight manner. When the valve is sealed tightly, pressure or vacuum may be developed inside the dispenser.

FIGS. 6-8 show an alternative construction of a dispenser of the present invention, generally indicated as 50. Dispenser 50 has a substantially rigid body 52 and a resilient bellows portion 54, which are preferably made similarly to rigid body 12 and resilient bellows portion 14. Dispenser 50 also has an opening 56 for fluid communication with an internal volume 58. Opening 56 is surrounded by an annular valve seat 60. Valve seat 60 and opening 56 may be molded as part of rigid body 52 or made into a separate member which is connected to body 52 in a fluid-tight manner.

Seated in opening 56 on valve seat 60 is a valve 64. Valve 64 has two parallel resilient disks 66 and 68 connected by a resilient cylinder. Valve 64 is preferably made of the same material as valve 24 and is mounted on a substantially rigid plastic stem 72. Plastic stem 72 extends downward along an axis 74 through the center of opening 56 from valve 64 to a counterweight 76. Counterweight 76 extends into internal volume 58, but short of an internal bottom surface 78 of resilient bellows portion 54. Stem 72 and counterweight 76 are made similarly to stem 32 and counterweight 36.

Counterweight 76 preferably has a center of gravity 80, which is located substantially along axis 74 when valve 64 is properly seated. Counterweight 76 also has a base 82, which is preferably shaped to mate with internal bottom surface 78. Bottom surface 78 preferably has a recess or funnel-shaped internal surface, so that when valve 64 is unseated, base 82 is easily centered on bottom surface 78. Alternatively, the internal bottom surface may be an upright projection, such as a domed pushup, and the mating base of the counterweight may be concave, as shown in FIGS. 2–5, to provide the centering function. Internal bottom surface 78 may be a separate injection molded member connected to resilient bellows portion 54 in a fluid-tight manner. FIG. 8 shows no fluid present, in order to avoid obscuring the view of the centering of base 82 in the recess of internal bottom surface 78. The attendant applies force F to cause the seating of valve 64, just as in FIG. 5.

FIG. 9 shows still another alternative embodiment of the dispenser of the present invention, generally indicated as 90. Dispenser 90 has a resilient bellows portion 92 located between substantially rigid upper and lower body portions 94 and 96, respectively. Dispenser 90 has internal centering valve features (not shown) similar to those of either dispenser 10 or dispenser 50. Dispenser 90 also has a valve seat and dispenser opening (not shown) located in either of body portions 94 or 96, similar to that of dispenser 50.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. An improved rinse water additive dispenser for an automatic washer having a spinning drum, said dispenser comprising a substantially rigid body having a resilient portion and an internal volume, said dispenser further including an opening therein and a valve for sealing said opening closed so that said rinse water additive is maintained within said dispenser until said valve is acted upon by centrifugal force applied to said dispenser during a spin cycle of said automatic washer to unseat said valve, said resilient portion providing for volumetric expansion and contraction of said dispenser when said dispenser is placed in variable temperature water, said volumetric expansion and contraction substantially relieving an air pressure differential between ambient and said internal volume so that said centrifugal force unseats said valve without interference from said pressure differential.

2. The dispenser of claim 1 wherein said opening is located in said resilient portion.

3. The dispenser of claim 1 wherein said opening is located in said substantially rigid body.

4. An improved rinse water additive dispenser for an automatic washer having a spinning drum, said dispenser comprising:

a) a substantially rigid portion having an internal volume;

b) a resilient bellows portion connected to and in fluid communication with said rigid portion, said resilient portion having an opening therein surrounded by a valve seat; and c) a valve seated on said valve seat to seal said opening and provide a closed dispenser, said valve having a rigid counterweight extending downward therefrom, said counterweight having a center of gravity along an axis substantially perpendicular to and centered on said opening, said counterweight sized to be pulled away from said axis in the presence of centrifugal force acting thereon during a washer spin cycle to unseat said valve and thereby open said dispenser so that an additive in said dispenser may thereafter mix with rinse water when said automatic washer fills with rinse water, said resilient bellows portion providing for volumetric expansion and contraction of said closed dispenser when said dispenser is placed in variable temperature water, said volumetric expansion and contraction substantially relieving an air pressure differential between ambient and said internal volume so that said centrifugal force unseats said valve with minimal interference from said pressure differential.

5. The dispenser of claim 4 wherein said resilient bellows portion has a collapse resistance sufficient to minimize bellows distortion when centrifugal force pulls said counterweight away from said axis, so that said force may unseat said valve.

6. The dispenser of claim 4 wherein said rigid counterweight has a base which mates with an internal bottom surface of said dispenser when said valve is unseated, in order to substantially center said valve along said axis, said resilient bellows portion being manually deformable to lower said valve seat into engagement with said valve after refilling said dispenser.

7. The dispenser of claim 6 wherein said internal bottom surface has an upright projection for engagement with a recessed surface of said counterweight to align said counterweight along said axis after it falls from said valve seat position.

8. The dispenser of claim 6 wherein said internal bottom surface has a recessed surface for engagement with a matingly shaped counterweight base to align said counterweight along said axis after it falls from said valve seat position.

9. An improved rinse water additive dispenser for an automatic washer having a spinning drum, said dispenser comprising:

a) a substantially rigid portion having an internal volume and an opening therein surrounded by a valve seat;

b) a resilient bellows portion connected to and in fluid communication with said rigid portion; and c) a valve seated on said valve seat to seal said opening and provide a closed dispenser, said valve having a rigid counterweight extending downward therefrom, said counterweight having a center of gravity along an axis substantially perpendicular to and centered on said opening, said counterweight sized to be pulled away from said axis in the presence of centrifugal force acting thereon during a washer spin cycle to unseat said valve and thereby open said dispenser so that an additive in said dispenser may thereafter mix with rinse water when said automatic washer fills with rinse water, said resilient bellows portion providing for volumetric expansion and contraction of said closed dispenser when said dispenser is placed in variable temperature water, said volumetric expansion and contraction substantially relieving an air pressure differential between ambient and said internal volume so that said centrifugal force unseats said valve with minimal interference from said pressure differential.

10. The dispenser of claim 9 wherein said rigid counterweight has a base which mates with an internal bottom surface of said dispenser when said valve is unseated, in order to substantially center said valve along said axis, said resilient bellows portion being manually deformable to lower said valve seat into engagement with said valve after refilling said dispenser.

11. The dispenser of claim 10 wherein said internal bottom surface has an upright projection for engagement with a recessed surface of said counterweight to align said counterweight along said axis after it falls from said valve seat position.

12. The dispenser of claim 10 wherein said internal bottom surface has a recessed surface for engagement with a matingly shaped counterweight base to align said counterweight along said axis after it falls from said valve seat position.

* * * * *